US011596188B2

(12) United States Patent
Choi

(10) Patent No.: US 11,596,188 B2
(45) Date of Patent: Mar. 7, 2023

(54) UPPER GARMENT WITH CUSTOMIZED SPINE SUPPORT DEVICE

(71) Applicant: Joon Hyeok Choi, Seongnam-si (KR)

(72) Inventor: Joon Hyeok Choi, Seongnam-si (KR)

( * ) Notice: Subject to any disclaimer, the term of this patent is extended or adjusted under 35 U.S.C. 154(b) by 0 days.

(21) Appl. No.: 17/409,287

(22) Filed: Aug. 23, 2021

(65) Prior Publication Data

US 2023/0018799 A1 Jan. 19, 2023

(30) Foreign Application Priority Data

Jul. 16, 2021 (KR) ..... 10-2021-0093766

(51) Int. Cl.
*A41D 13/05* (2006.01)

(52) U.S. Cl.
CPC ..... *A41D 13/0531* (2013.01)

(58) Field of Classification Search
CPC ..... A41D 13/0531; A61F 5/026
See application file for complete search history.

(56) References Cited

U.S. PATENT DOCUMENTS 1,316,915 A * 9/1919 Meyer et al. ..... A61F 5/028 602/19
4,680,812 A * 7/1987 Weigl ..... A41D 13/0531 2/2.5
4,771,767 A * 9/1988 Steffee ..... A61B 17/7044 606/279
4,911,346 A * 3/1990 Shallman ..... A45F 3/08 224/261
5,140,995 A * 8/1992 Uhl ..... A63B 71/08 2/92
5,328,447 A * 7/1994 Kapounek ..... A61F 5/055 2/92
5,400,801 A * 3/1995 Archer, III ..... A41D 13/0153 2/92
5,768,717 A * 6/1998 Le Sueur ..... A41D 13/015 2/455
5,840,051 A * 11/1998 Towsley ..... A61F 5/0125 602/19
6,427,695 B1 * 8/2002 Zanetti ..... A41D 13/0531 128/869
6,687,920 B2 * 2/2004 Berns ..... A41D 13/0531 2/92
6,852,087 B1 * 2/2005 Dainese ..... A41D 13/0153 2/455
7,329,230 B2 * 2/2008 Mazzarolo ..... A41D 13/0531 2/455
7,654,973 B2 * 2/2010 Firsov ..... A61F 5/026 128/869

(Continued)

FOREIGN PATENT DOCUMENTS

FR 2706318 A1 * 12/1994 ..... A41D 13/015
GB 2249942 A * 5/1992 ..... A41D 13/0531

(Continued)

*Primary Examiner* — F Griffin Hall
(74) *Attorney, Agent, or Firm* — Paratus Law Group, PLLC

(57) ABSTRACT

Disclosed is an upper garment with a customized spine support device. The upper garment includes an upper garment body having a back plate portion and a front plate portion and applied to an upper body; and a spine support device that presses and supports a spine of a wearer to maintain a spacing between vertebras.

6 Claims, 10 Drawing Sheets

(56) References Cited

U.S. PATENT DOCUMENTS

| | | | | |
|---|---|---|---|---|
| 8,074,294 | B2 * | 12/2011 | Bowlus | A63B 71/1291 2/44 |
| 8,474,067 | B2 * | 7/2013 | Reimer | A41D 13/0531 2/467 |
| 9,216,121 | B2 * | 12/2015 | Galante | A61F 5/022 |
| 9,221,373 | B1 * | 12/2015 | McAllister | B60N 2/643 |
| 9,232,825 | B2 * | 1/2016 | Bencini | A41D 13/0531 |
| 9,370,237 | B2 * | 6/2016 | Hiemenz | A41D 13/0531 |
| 9,504,307 | B1 * | 11/2016 | Burnett | A45F 3/10 |
| 10,092,044 | B2 * | 10/2018 | Skottheim | A41D 13/0531 |
| 11,123,214 | B2 * | 9/2021 | Wilson | A61F 5/028 |
| 11,185,119 | B2 * | 11/2021 | Diamond | A41D 31/245 |
| 11,278,441 | B2 * | 3/2022 | Saban | A61F 5/05883 |
| 2010/0263111 | A1 * | 10/2010 | Leatt | A41D 13/0531 2/467 |
| 2013/0283511 | A1 * | 10/2013 | Diamond | A63B 71/12 2/455 |
| 2018/0180387 | A1 * | 6/2018 | Caballero | F41H 1/02 |
| 2021/0274859 | A1 * | 9/2021 | Saggio | A45F 3/08 |

FOREIGN PATENT DOCUMENTS

| | | | | | |
|---|---|---|---|---|---|
| JP | 2000110012 | A | * | 4/2000 | A41D 13/0531 |
| KR | 20030003796 | A | * | 7/2001 | |
| KR | 10-0681890 | B1 | | 2/2007 | |
| KR | 10-0894722 | B1 | | 4/2009 | |
| KR | 10-1545610 | B1 | | 8/2015 | |

* cited by examiner

UPPER GARMENT WITH CUSTOMIZED SPINE SUPPORT DEVICE

CROSS-REFERENCE TO PRIOR APPLICATION

This application claims priority to Korean Patent Application No. 10-2021-0093766 (filed on Jul. 16, 2021), which is hereby incorporated by reference in its entirety.

BACKGROUND

The present invention relates to an upper garment with a spine support device, and more specifically, to an upper garment with a customized spine support device capable of minimizing spinal injuries caused by external shocks by elastically supporting a spine of a user who wears the upper garment.

Motorcycles can pass through clogged roads and narrow alleys without any problems, and have the advantage of being faster than bicycles, so the motorcycles are extensively used for quick service and food delivery in crowded cities.

However, since the motorcycle itself does not protect occupants, there is a very high probability that the occupant will be killed or seriously injured if, for example, the motorcycle slips or collides with another vehicle while driving. For this reason, when riding the motorcycle, it is essential to wear various safety protection equipment, such as a helmet to protect the head and gloves, and if possible, it is recommended to wear elbow, shoulder, knee, flank, chest, and spine protectors.

As an alternative to the protector, an airbag jacket has also been proposed. The airbag jacket has a structure in which an airbag is integrally mounted with a jacket, and the airbag is inflated to protect the occupant upon an accident. However, the airbag jacket is heavy and blunt, and has disadvantages that the airbag needs to be discarded once the airbag is inflated, so it is rarely used in practice.

Meanwhile, when a motorcycle accident occurs, spinal injuries may lead to paralysis or hemiplegia, so protection of the spine as well as the head is very important. Thus, it is necessary to wear a spin protector with an optimum protection performance.

For this reason, spine protectors having various designs have been developed and known. However, most of conventional spine protectors have a limitation in that they have a structure that simply covers the user's back plate. In other words, the shape of the spine, which is slightly different for each individual, is not considered in the design, so the conventional spine protector does not make close contact with the vertebra constituting the spine.

RELATED ART DOCUMENTS

Patent Documents

Korean Registered Patent Publication No. 10-1545610 (Protector applied to body of motorcycle rider)

Korean Registered Patent Publication No. 10-0894722 (Air tube type upper body protector for motorcycle)

Korean Registered Patent Publication No. 10-0681890 (Protector for motorcycle rider)

SUMMARY

The present invention has been made to solve the above problems, and an object of the present invention is to provide an upper garment with a customized spine support device, which can stably support a vertebra of a wearer, so that it is convenient and excellent in protecting a spine, and which can make close contact with the spine without causing any sense of difference.

In order to achieve the above object, there is provided an upper garment with a customized spine support device, in which the upper garment includes: an upper garment body having a back plate portion and a front plate portion and applied to an upper body; and a spine support device that is mounted inside the back plate portion and presses and supports a spine of a wearer who wears the upper garment body to maintain a spacing between vertebras.

In addition, the spine support device may include: a mounting base that is fixed to an inner side of the back plate portion to provide a support force; a plurality of unit supports that are installed on the mounting base such that a spacing between the unit supports is adjustable, correspond to the vertebras in one-to-one correspondence, and support each vertebra in a state in which the spacing is set; and a spacing adjusting unit configured to adjust and maintain the spacing of the unit supports.

Further, the mounting base may include: a mounting rail extending parallel to the spine and having a predetermined sectional shape in the extension direction thereof; and a fixing plate configured to fix the mounting rail to the back plate portion.

In addition, each of the unit supports may include: a close contact body that is supported on the mounting rail such that a position of the unit support is adjustable and provides an open groove directed toward the vertebra; an upper bracket fixed to an upper end of the close contact body; and a lower bracket fixed to a lower end of the close contact body, and the spacing adjusting unit may adjust the spacing between the upper and lower brackets in a state in which the lower bracket of an upper unit support and the upper bracket of a lower unit support in two adjacent unit supports are connected to each other.

Further, a soft liner, which is elastically deformable and includes a vertebra support groove having a volume for accommodating the vertebra corresponding to the close contact body, may be detachably attached to the open groove of the close contact body.

In addition, elongate holes may be formed through both ends of the upper and lower brackets, and the spacing adjusting unit may include: a stud bolt located between the upper bracket and the lower bracket, and having an upper end passing through the elongate hole of the upper bracket and a lower end passing through the elongate hole of the lower bracket; a spring that surrounds the stud bolt and elastically supports the upper and lower brackets in a direction in which the upper and lower brackets are away from each other; and a spacing adjusting nut that is screw-coupled to the upper and lower ends of the stud bolt to compress the spring and to adjust and maintain the spacing between the upper and lower brackets.

Further, the spacing adjusting unit may include: a right-hand screw portion located between the upper bracket and the lower bracket, and screw-coupled to the upper bracket; a left-hand screw portion screw-coupled to the lower bracket; and a spacing adjusting bolt located between the right-hand screw portion and the left-hand screw portion and having a handle that rotates by receiving rotational force transferred from an outside to adjust the spacing between the upper and lower brackets.

In addition, the spacing adjusting unit may be located on both sides of the close contact body, and a protective cover may be further provided at both sides of the close contact body to accommodate the spacing adjusting unit.

The upper garment provided with the customized spine support device of the present invention having the above configuration can stably support the vertebra of the user who wears the upper garment, so it is convenient and has an excellent effect of protecting the spine when external shocks are applied thereto.

In addition, since it is possible to adjust the spacing of the unit supports that individually support the vertebra, micro settings can be made according to the body shape after purchase, so that it can make close contact with the spine without causing any sense of difference.

DETAILED DESCRIPTION

Hereinafter, one embodiment according to the present invention will be described in more detail with reference to the accompanying drawings.

Figure 1:
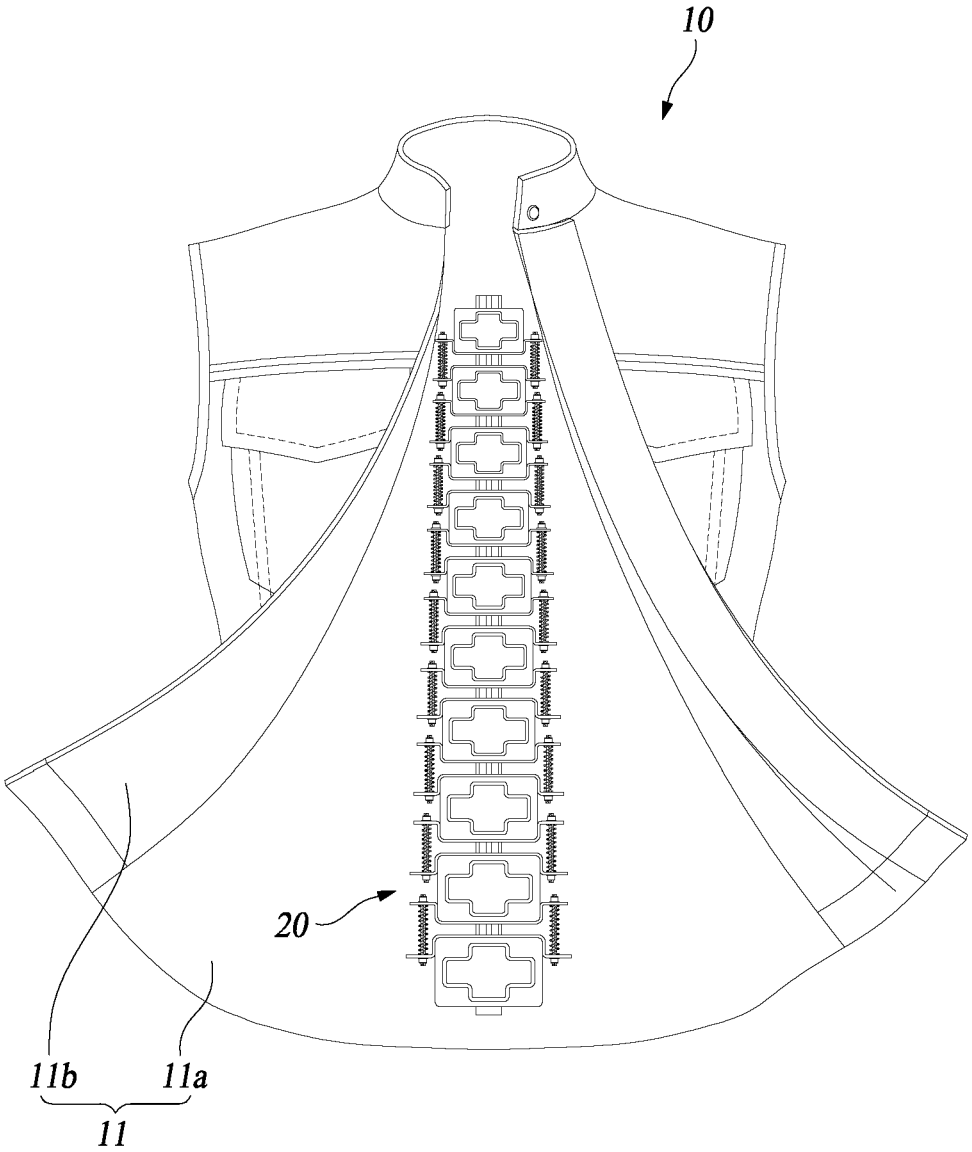
FIG. 1 is a view showing an upper garment with a customized spine support device according to an embodiment of the present invention.

FIG. 1 is a view showing an upper garment 10 with a customized spine support device according to an embodiment of the present invention.

As shown in FIG. 1, an upper garment 10 provided with a customized spine support device according to the present embodiment may include an upper garment body 11 and a spine support device 20.

The upper garment body 11 is a general garment applied to an upper body of a wearer, and may have a back plate portion 11*a* and a front plate portion 11*b*. Typically, the back plate portion 11*a* covers a back portion of the wearer, and the front plate portion 11*b* covers a chest and abdomen portions of the wearer. As long as it can be applied to the upper body of the wearer, various types of the upper garment body 11 may be adopted.

The spine support device 20 may be mounted on an inner surface of the back plate portion 11*a*, and when the wearer wears the upper garment body 11, the spine support device 20 may elastically support the spine in a state in which the spine support device 20 is automatically fitted to the spine (the term 'spine' in the present specification is precisely the 'thoracic vertebra'. The thoracic vertebra is located between the cervical and lumbar vertebra and consists of 12 bones. However, in the following description, the term 'spine' will be used because it is more generally used).

The spine support device 20 may be visually checked when the front plate portion 11*b* is lifted. However, in some cases, it is also possible to add a lining to the front of the spine support device 20.

Figure 2:
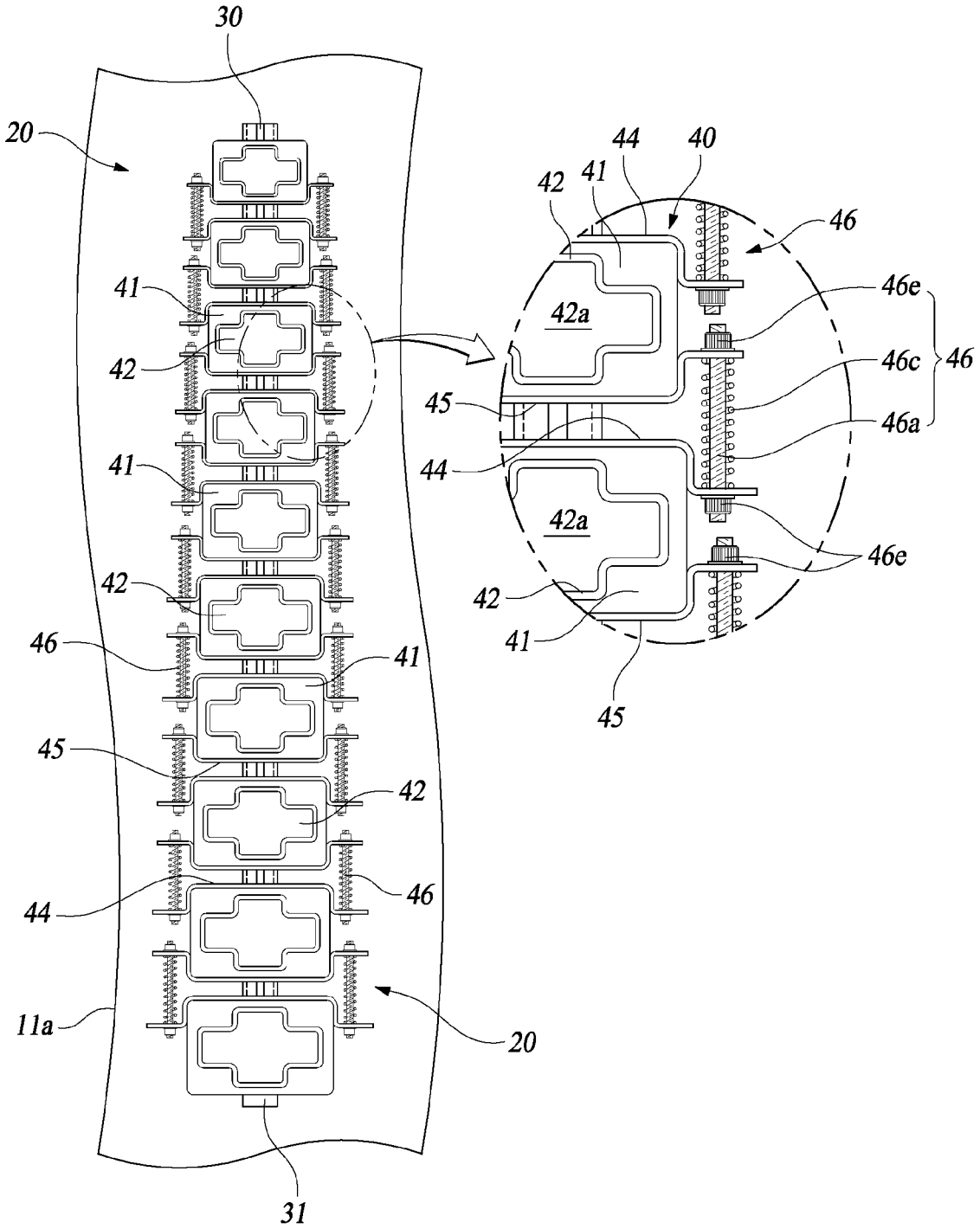
FIG. 2 is a front view showing the spine support device of FIG. 1.
Figure 3:
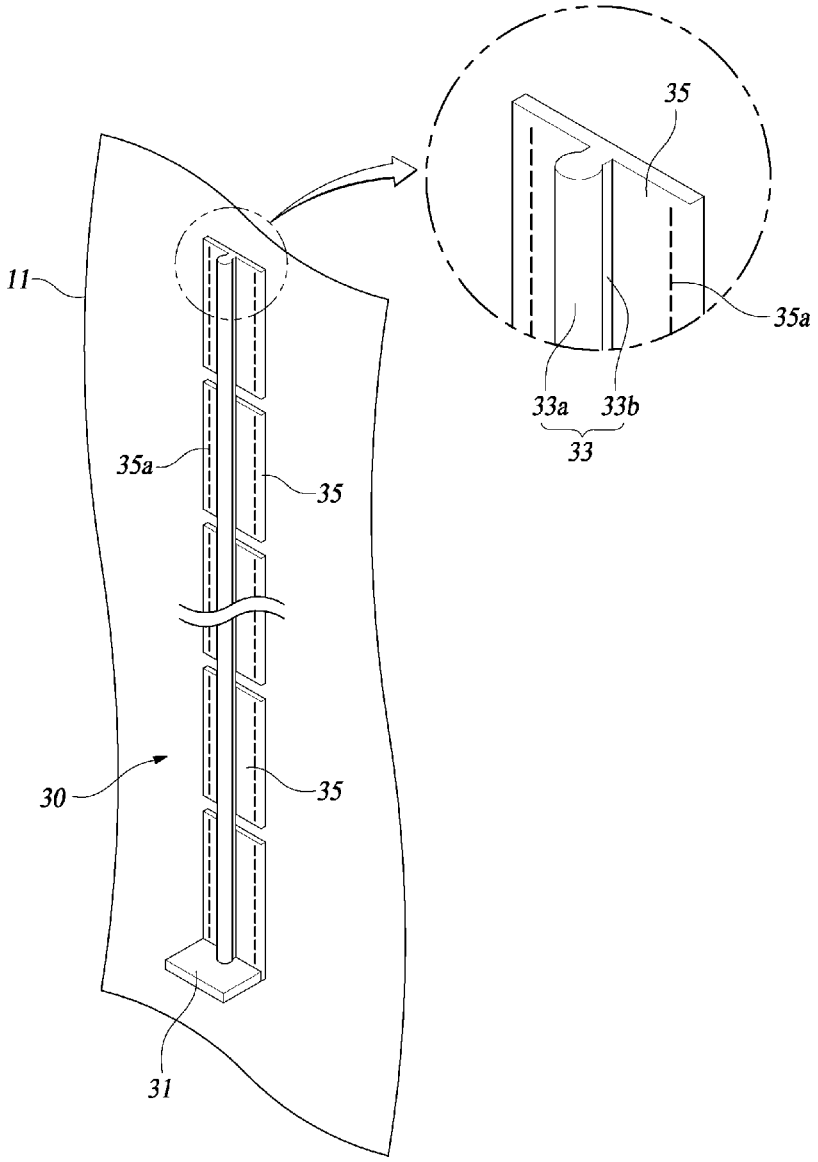
FIG. 3 is a view for explaining the configuration of an elastic supporter in the customized spine support device of FIG. 1.
Figure 4:
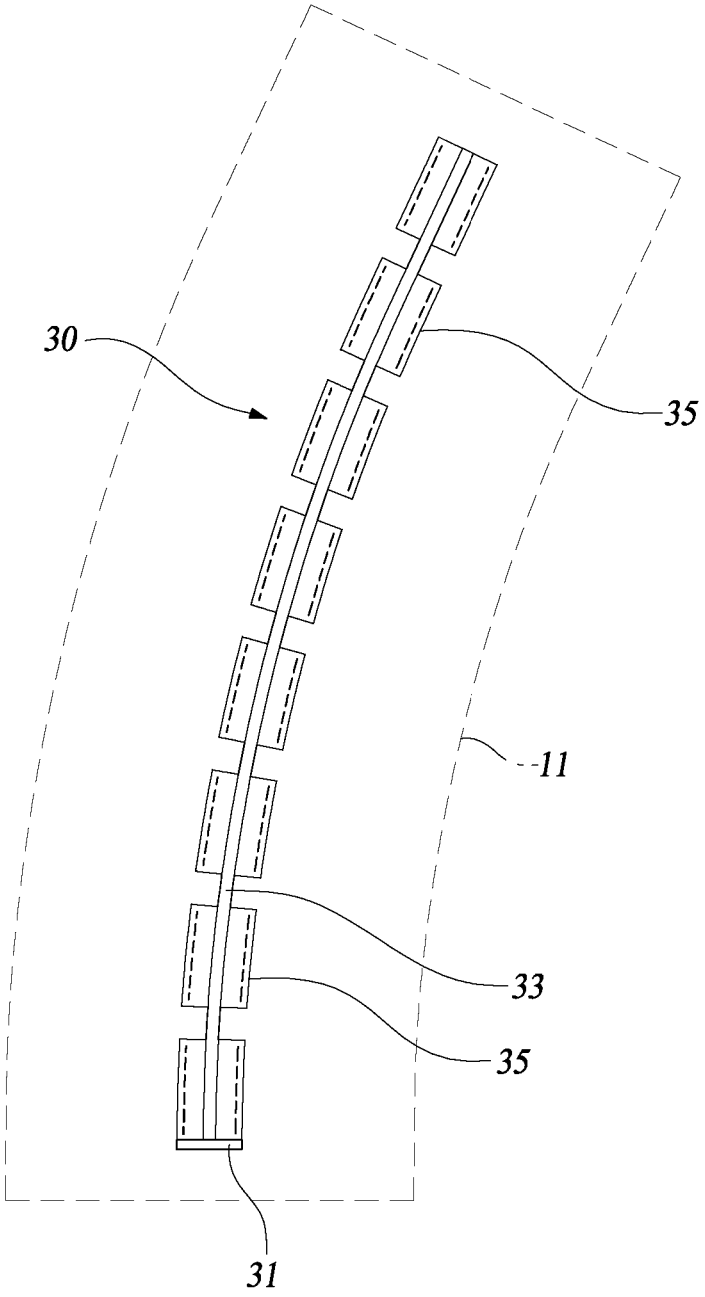
FIGS. 4 and 5 are views showing the features of the elastic supporter of FIG. 3.
Figure 5:
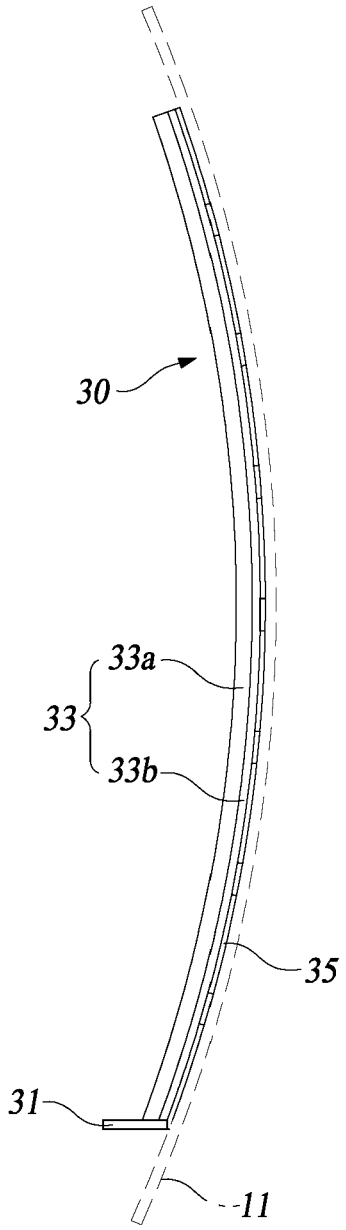

FIG. 2 is a front view showing only the spine support device 20 of FIG. 1, and FIG. 3 is a view for explaining the configuration of the elastic supporter in the spine support device. In addition, FIGS. 4 and 5 are views showing the features of the elastic supporter of FIG. 3.

Referring to the drawings, the spine support device 20 may include a mounting base 30, a plurality of unit supports 40, and a spacing adjusting unit 46.

The mounting base 30 may serve to support the unit support 40 on an inner surface of the back plate portion 11*a* in a state in which the mounting base 30 is fixed in parallel with the spine. The mounting base 30 may have a fixing plate 35 and a mounting rail 33.

The fixing plate 35 may be a square plate having a predetermined thickness and a plurality of fixing plates 35 may be provided while being spaced apart from each other. The fixing plate 35 may be fixed to the back plate portion 11*a*. The fixing plate 35 may be fixed to the back plate portion 11*a* in various ways. For example, it is possible to use a bonding method or a sewing method. FIG. 3 shows the fixing plate 35 fixed by the sewing method, in which sewing lines 35*a* can be seen at both ends in the width direction of the fixing plate 35.

Since the plurality of fixing plates 35 are arranged while being spaced apart from each other, the mounting base 30 may be more easily bent. That is, the spine may be bent when the wearer bends the upper body forward, backward, leftward, or rightward, and at this time, the mounting base 30 may also be bent together with the spine.

The mounting rail 33 may be a part integrally formed with the fixing plate 35 and may have a predetermined sectional shape in the longitudinal direction. The mounting rail 33 may have an insertion portion 33*a* and a neck portion 33*b*. The insertion portion 33*a* may be a part fitted to a rail holding slit 41*e* of a close contact body 41, and the neck portion 33*b* may be a part connecting the insertion portion 33*a* to the fixing plate 35.

A lower end support 31 may be positioned at the lower end of the mounting rail 33. The lower end support 31 may be a support device for preventing the unit support 40 installed on the mounting base 30 from falling downward.

The mounting base 30 having the above configuration may be formed of elastically deformable synthetic resin. Since the mounting base 30 is elastically deformable, for example, if the mounting base 30 is released after being bent to one side by applying an external force, the mounting base 30 may return to the initial straight state.

FIG. 4 is a view when the wearer of the upper garment 10 bends the upper body in the direction of an arrow c. When the upper body is bent to the lateral side, the shoulder may be inclined and the back plate portion 11*a* and the mounting base 30 may be bent together. FIG. 5 is a view showing the appearance of the back plate portion 11*a* and the mounting base 30 when the upper body is bent forward. Of course, if the upper body is erected in this state, the mounting base 30 may be unfolded again in a straight state.

Since the mounting base 30 can be bent, the unit support 40 supported on the mounting base 30 may always come into close contact with the spine. That is, even if the wearer of the upper garment 10 bends the upper body in various directions, the unit support 40 can maintain the state in which the spine is supported. The vertebral portion is the central portion of the back.

Figure 6:
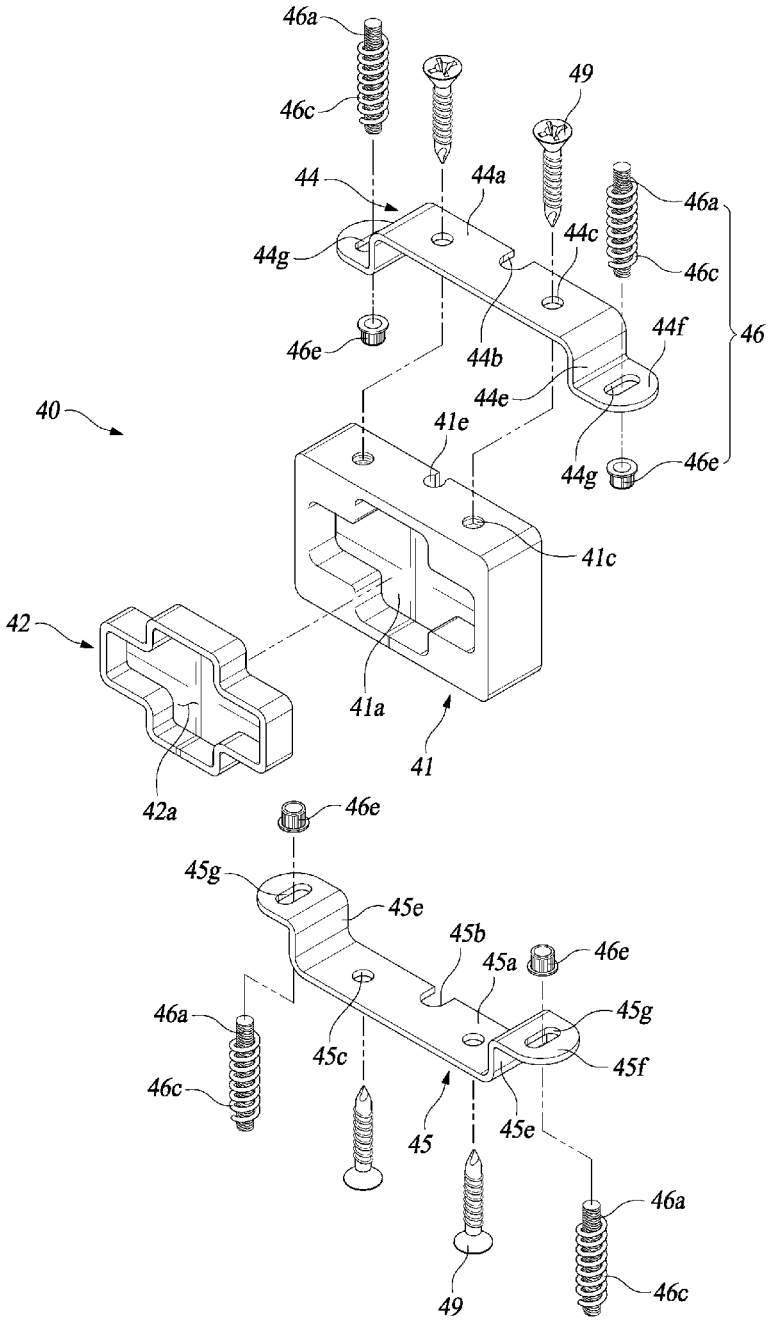
FIG. 6 is an exploded perspective view separately showing a unit support and a spacing adjusting unit shown in FIG. 2.
Figure 7:
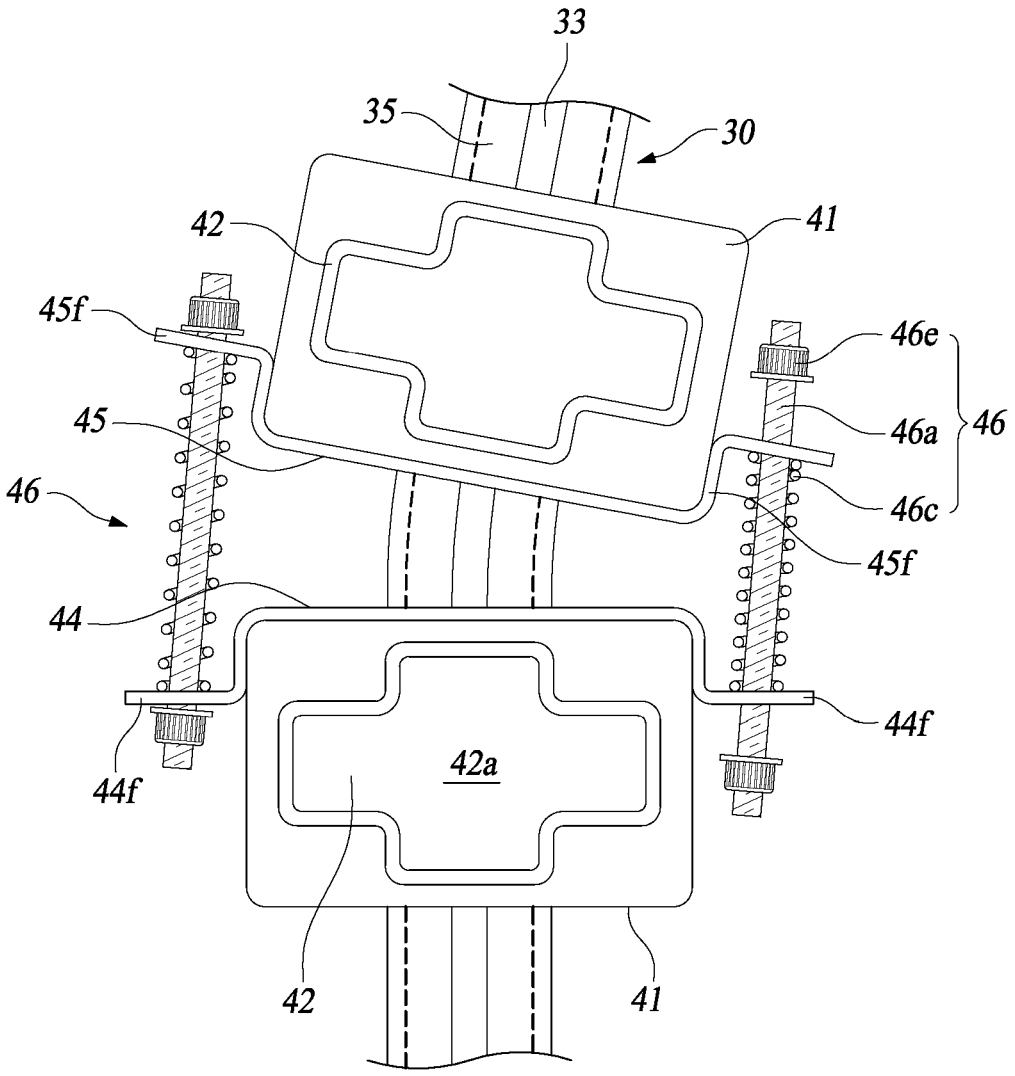
FIGS. 7 and 8 are views for explaining the operation of the spacing adjusting unit of FIG. 6.
Figure 8:
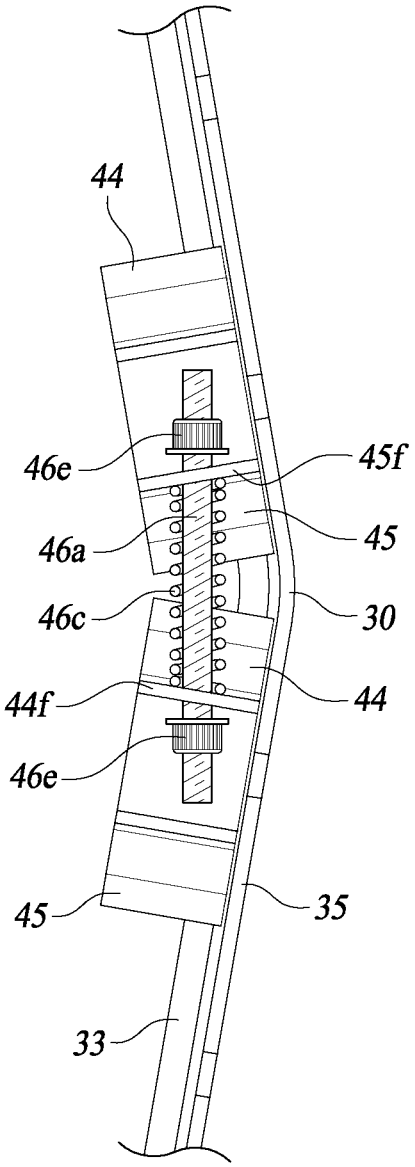

FIG. 6 is an exploded perspective view illustrating the unit support 40 and the spacing adjusting unit 46 shown in FIG. 2, and FIGS. 7 and 8 are views for explaining the operation of the spacing adjusting unit of FIG. 6.

The unit support 40 may be installed on the mounting base 30 such that the spacing between unit supports 40 is adjustable, may correspond to the vertebras in one-to-one correspondence, and may serve to support each vertebra in a state in which the spacing thereof is set. In addition, the spacing adjusting unit 46 may serve to adjust and maintain the spacing between the neighboring unit supports 40.

As shown in the drawings, the unit support 40 may include the close contact body 41, the upper bracket 44, and the lower bracket 45.

The close contact body 41 may be formed in a substantially hexahedral shape, and may have an open groove 41*a* on the front surface (the surface facing the spine) thereof and a rail holding slit 41*e* on the rear surface (the surface facing the mounting base) thereof. The close contact body 41 may be formed of synthetic resin or rubber. As shown in FIG. 2, the size of the close contact body 41 having the above configuration may be gradually increased in the downward direction. The reason for setting the size of the close contact body to be increased in the downward direction is that the vertebras constituting the spine become larger in the downward direction.

The open groove 41*a* may be a substantially cross-shaped groove that is opened toward the spine and detachably accommodates a soft liner 42. The soft liner 42 may be an element formed of silicone and provide a vertebra support groove 42*a* that is opened toward the front. The vertebra support groove 42*a* may support the vertebras of the wearer. For example, vertebra support groove 42*a* may support the spinous process or transverse process parts constituting the vertebra.

In particular, since the soft liner 42 may be detachable with respect to the open groove 41*a*, it is possible to replace the soft liner 42. For example, the used soft liner may be removed and replaced with a thicker and softer soft liner.

The rail holding slit 41*e* may be a straight groove for accommodating the mounting rail 33. The position of the close contact body 41 may be adjustable in the longitudinal direction of the mounting rail 33 in a state in which the mounting rail 33 is fitted into the rail holding slit 41*e*.

In addition, female screw holes 41*c* may be provided in a top surface and a bottom surface of the close contact body 41 (although only the female screw hole 41*c* formed in the top surface is seen in FIG. 8, the same female screw hole may also be formed in the bottom surface). A fixing screw 49 may be coupled to the female screw hole 41*c*.

The upper bracket 44 may be formed by pressing a band-shaped member having a predetermined thickness and width, and may have a cover portion 44*a*, a primary bent portion 44*e*, and a secondary bent portion 44*f*.

The cover portion 44*a* may a part for covering the top surface of the close contact body 41 and may have a screw hole 44*c* and a rail passage groove 44*b*. The screw hole 44*c* may correspond to the female screw hole 41*c* and the fixing screw 49 may pass through the screw hole 44*c*. After placing the upper bracket 44 on the upper portion of the close contact body 41, the screw hole 44*c* may match the female screw hole 41*c*, and the fixing screw 49 may be screw-coupled to the female screw hole 41*c* through the screw hole 44*c*, thereby fixing the upper bracket 44 to the close contact body 41.

The rail passage groove 44*b* may be a groove through which the mounting rail 33 may pass.

The primary bent portion 44*e* may be a part which is bent downward at right angles from both ends of the cover portion 44*a* and allows the secondary bent portion 44*f* to be stepped with respect to the cover portion 44*a*. The secondary bent portion 44*f* may be a part, which is bent outward at a right angle from the lower end of the primary bent portion 44*e*. A elongate hole 44*g* may be formed through the secondary bent portion 44*f*. The elongate hole 44*g* may be a hole through which the upper end of the stud bolt 46*a* to be described below may pass.

The lower bracket 45 may have the same shape as the upper bracket 44 and may cover the lower end of the close contact body 41. The lower bracket 45 may be provided with a cover portion 45*a*, a primary bent portion 45*e*, and a secondary bent portion 45*f*.

The cover portion 45*a* may be a part that covers the bottom surface of the close contact body 41, and may have two screw holes 45*c* and a rail passage groove 45*b*. The screw hole 44*c* may be a hole through which the fixing screw 49 may pass upward. The method of fixing the lower bracket 45 to the close contact body 41 using the fixing screw 49 may be the same as the case of the upper bracket. In addition, the rail passage groove 45*b* may be a groove through which the mounting rail 33 may pass.

In addition, the primary bent portion 45*e* may be a part, which is bent upward at right angles from both ends of the cover portion 45*a* and allows the secondary bent portion 45*f* to be stepped with respect to the cover portion 45*a*. The secondary bent portion 45*f* may be a part, which is bent outward at right angles from the upper end of the primary bent portion 45*e*, and has an elongate hole 45*g*. The elongate hole 45*g* may be a hole through which the lower end of the stud bolt 46*a* to be described below may pass.

Meanwhile, the spacing adjusting unit 46 may serve to adjust the spacing between the upper and lower brackets 44 and 45 in a state in which the lower bracket 45 of an upper unit support and the upper bracket 44 of a lower unit support in two unit supports 40 vertically adjacent to each other are connected to each other. Adjusting the spacing between the upper and lower brackets means adjusting the spacing between the upper unit support and the lower unit support.

The spacing adjusting unit 46 may be installed between the secondary bent portion 44*f* of the upper bracket 44 and the secondary bent portion 45*f* of the lower bracket 45. The spacing adjusting units 46 may be located in opposition to each other with the close contact body 41 interposed therebetween.

The spacing adjusting unit 46 may include a stud bolt 46*a*, a spring 46*c*, and a spacing adjusting nut 46*e*. The stud bolt 46*a* may be a mechanical element in which a male thread is formed on an outer peripheral surface thereof. The upper end of the stud bolt 46*a* may be fitted into the elongate hole 45*g* formed in the lower bracket 45 of the upper unit support 40. In addition, the lower end of the stud bolt may be fitted into the elongate hole 44*g* formed in the upper bracket 44 of the lower unit support 40. The stud bolt may connect two unit supports 40 adjacent to each other in the vertical direction.

In addition, the spacing adjusting nut 46*e* may be screw-coupled to the upper end and lower end of the stud bolt 46*a*. As shown in FIG. 7, the spacing adjusting nut 46*e* shown in the upper portion in the drawing may be caught on the upper portion of the secondary bent portion 45*f* of the lower bracket 45, and the spacing adjusting nut shown in the lower portion in the drawing may be caught on the lower portion of the secondary bent portion 44*f* of the upper bracket 44.

In addition, the spring 46*c* may surround the stud bolt 46*a* and elastically support the upper and lower brackets in a direction in which the upper and lower brackets are away from each other. That is, the spring may allow the upper and lower brackets to be elastically spaced apart from each other in a state in which the spring is located between the secondary bent portion 45*f* of the lower bracket and the secondary bent portion 44*f* of the upper bracket. The spring 46*c* may keep the compressed state always.

The spacing distance between the upper and lower brackets 44 and 45 may be adjusted by the spacing adjusting nut 46*e*. That is, when the spacing between the spacing adjusting nuts 46*e* is narrowed, the spacing between the unit supports 40 may be narrowed. In contrast, when the spacing between the spacing adjusting nuts 46*e* is widened, the spacing between the unit supports 40 may be widened. As a result, the spacing of the unit supports 40 constituting the spine support device 20 may be adjusted by using the spacing adjusting nut 46*e*.

The reason for adjusting the spacing of the unit support 40 is to fit the spine support device 20 to the shape of the spine of the wearer who wears the upper garment. That is, since the spacing between the vertebras constituting the spine is slightly different according to the height difference or body type of the individual, the spacing of the unit supports 40 is adjusted to fit the spine support device 20 to the body.

In particular, since the unit supports 40, which are adjacent to each other in the vertical direction, can maintain the open state by the elastic force of the spring 46*c*, and the mounting base 30 can be deformed, even if the wearer bends the upper body from side to side or forward as shown in FIG. 7 or 8, the unit support may accept this motion. Even if the upper body is bent or tilted, the soft liner 42 may always support the vertebras. Of course, when the upper body is erected, the spine support device 20 may be elastically restored in a straight line.

Figure 9:
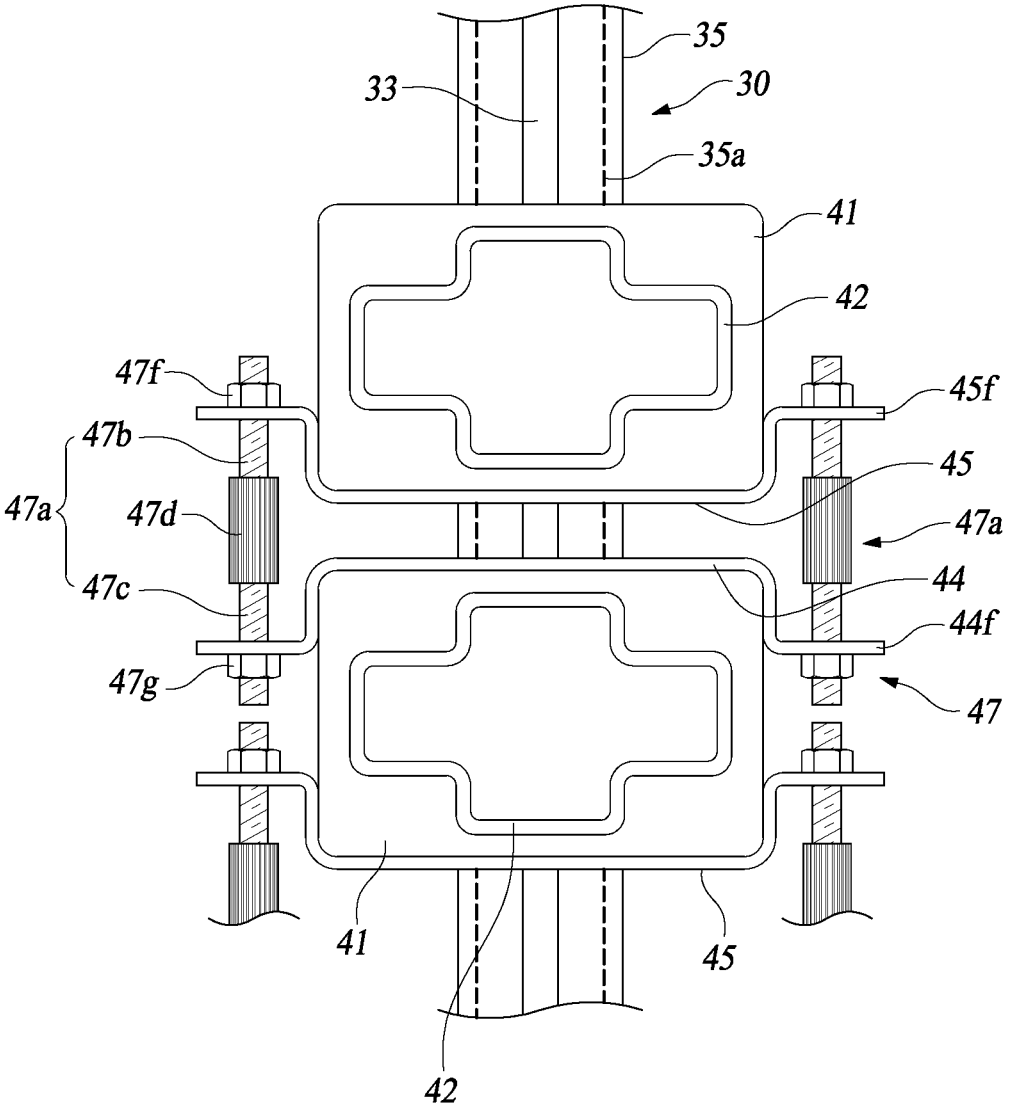
FIG. 9 is a view showing another example of a spine support device according to an embodiment of the present invention.

FIG. 9 is a view showing another example of the spine support device 20 according to an embodiment of the present invention.

Throughout the specification, the same reference numerals refer to the same members having the same functions.

A spacing adjusting unit 47 in the spine support device 20 shown in FIG. 9 may include a spacing adjusting bolt 47*a* and two fixing nuts 47*f* and 47*g*.

One fixing nut 47*f* of the two fixing nuts may be fixed to the secondary bent portion 45*f* of the lower bracket 45, and the other fixing nut 47*g* may be fixed to the secondary bent portion 44*f* of the upper bracket 44. In particular, the thread of the fixing nut 47*f* fixed to the lower bracket 45 may be a left-hand thread, and the thread of the fixing nut 47*g* mounted on the upper bracket 44 may be a right-hand thread.

The spacing adjusting bolt 47*a* may be located between the secondary bent portion 44*f* of the upper bracket of a lower unit support 40 and the secondary bent portion 45*f* of the lower bracket of an upper unit support 40 in the unit supports 40, which are adjacent to each other in the vertical direction.

The spacing adjusting bolt 47*a* may have a left-hand screw portion 47*b*, a right-hand screw portion 47*c*, and a handle portion 47*d*. The left-hand screw portion 47*b* may be screw-coupled to the fixing nut 47*f* of the lower bracket 45, and the right-hand screw portion 47*c* may be screw-coupled to the fixing nut 47*g* of the upper bracket 44.

The handle portion 47*d* may connect the right-hand screw portion and the left-hand screw portion and rotate by receiving rotational force transferred from the outside, thereby causing the right-hand and left-hand screw portions to rotate. As the right-hand screw portion 47*c* and the left-hand screw portion 47*b* rotate, the spacing between the upper bracket and the lower bracket may be adjusted.

Figure 10:
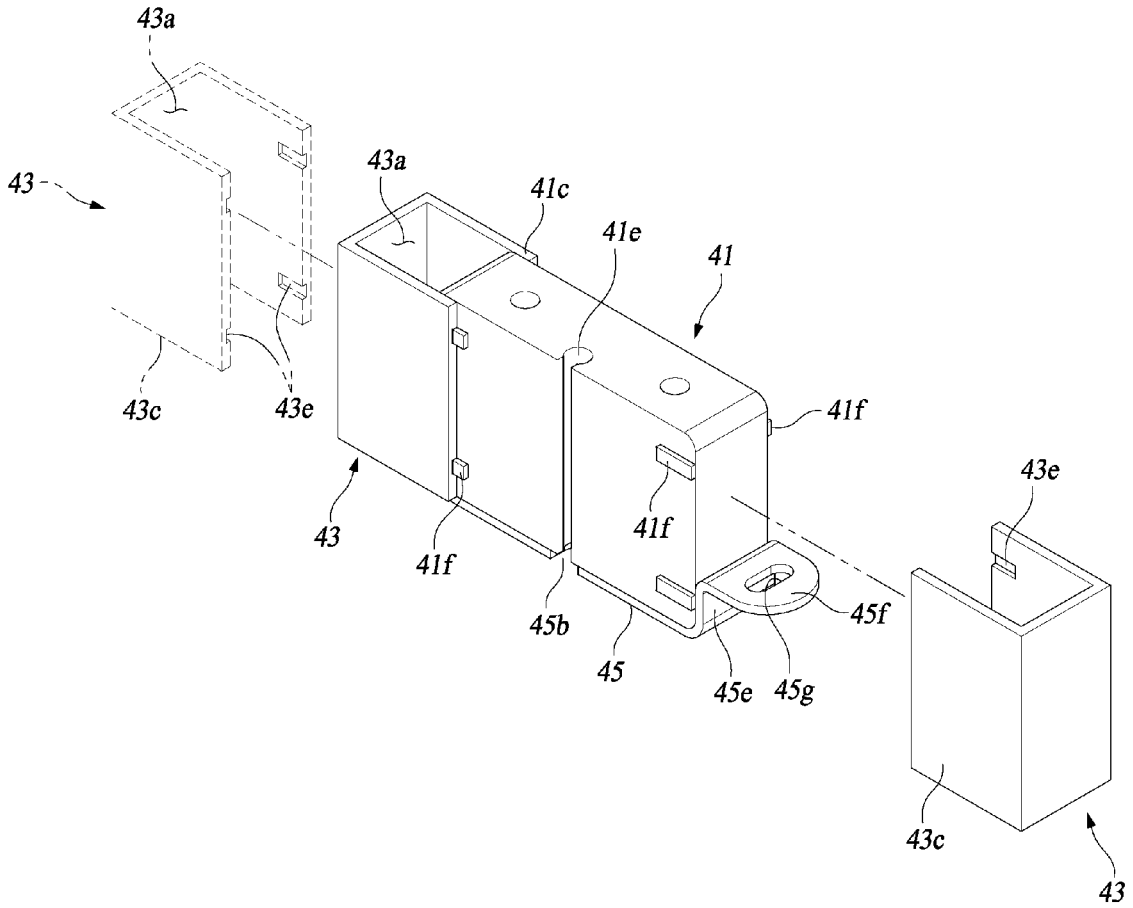
FIG. 10 is a view showing a modified example of the unit support of FIG. 6.

FIG. 10 is a view showing a modified example of the unit support 40 of FIG. 6.

Referring to FIG. 10, it can be seen that protective covers are installed on both sides of the unit support 40. The protective cover 43 may accommodate the spacing adjusting units 46 and 47 to block external force applied to the spacing adjusting units 46 and 47. For example, the protective covers may prevent the spacing adjusting nut 46*e* or the spacing adjusting bolt 47*a* from being rotated by making contact with a peripheral portion (such as the fabric of the back plate portion or the wearer's body).

A plurality of fixing protrusions 41*f* may be formed on the outer surface of the close contact body 41 so that the protective cover 43 can be mounted on the unit support 40, and protrusion grooves 43*e* may be formed at an inner surface of the protective cover 43. By fitting the fixing protrusion 41*f* into the protrusion groove 43*e*, the protective cover 43 may be assembled to the close contact body 41.

Although the present invention has been described above in detail through specific embodiments, the present invention is not limited to the above embodiments, and various modifications are possible by those of ordinary skill within the scope of the technical spirit of the present invention.

What is claimed is:

1. An upper garment with a customized spine support device, the upper garment comprising:

an upper garment body having a back plate portion and a front plate portion and applied to an upper body; and a spine support device that is mounted inside the back plate portion and presses and supports a spine of a wearer who wears the upper garment body to maintain a spacing between vertebras, wherein the spine support device includes:

a mounting base that is fixed to an inner side of the back plate portion to provide a support force;

a plurality of unit supports that are installed on the mounting base such that a spacing between the unit supports is adjustable, correspond to the vertebras in one-to-one correspondence, and support each vertebra in a state in which the spacing is set; and a spacing adjusting unit configured to adjust and maintain the spacing of the unit supports, wherein the mounting base includes:

a mounting rail extending parallel to the spine and having a predetermined sectional shape in the extension direction thereof; and a fixing plate configured to fix the mounting rail to the back plate portion, and wherein each of the unit supports includes: a close contact body that is supported on the mounting rail such that a position of the unit support is adjustable and provides an open groove directed toward the vertebra; an upper bracket fixed to an upper end of the close contact body; and a lower bracket fixed to a lower end of the close contact body, and the spacing adjusting unit adjusts the spacing between the upper and lower brackets in a state in which the lower bracket of an upper unit support and the upper bracket of a lower unit support in two adjacent unit supports are connected to each other.

2. The upper garment of claim 1, wherein a soft liner, which is elastically deformable and includes a vertebra support groove having a volume for accommodating the vertebra corresponding to the close contact body, is detachably attached to the open groove of the close contact body.

3. The upper garment of claim 1, wherein elongate holes are formed through both ends of the upper and lower brackets, and the spacing adjusting unit includes:

a stud bolt located between the upper bracket and the lower bracket, and having an upper end passing through the elongate hole of the upper bracket and a lower end passing through the elongate hole of the lower bracket;

a spring that surrounds the stud bolt and elastically supports the upper and lower brackets in a direction in which the upper and lower brackets are away from each other; and a spacing adjusting nut that is screw-coupled to the upper and lower ends of the stud bolt to compress the spring and to adjust and maintain the spacing between the upper and lower brackets.

4. The upper garment of claim 3, wherein the spacing adjusting unit is located on both sides of the close contact body, and a protective cover is further provided at both sides of the close contact body to accommodate the spacing adjusting unit.

5. The upper garment of claim 1, wherein the spacing adjusting unit includes:

a right-hand screw portion located between the upper bracket and the lower bracket, and screw-coupled to the upper bracket;

a left-hand screw portion screw-coupled to the lower bracket; and a spacing adjusting bolt located between the right-hand screw portion and the left-hand screw portion and having a handle that rotates by receiving rotational force transferred from an outside to adjust the spacing between the upper and lower brackets.

6. The upper garment of claim 5, wherein the spacing adjusting unit is located on both sides of the close contact body, and a protective cover is further provided at both sides of the close contact body to accommodate the spacing adjusting unit.

* * * * *